US007287527B1

(12) United States Patent
Piper

(10) Patent No.: US 7,287,527 B1
(45) Date of Patent: Oct. 30, 2007

(54) COMPRESSED GAS BB AIRGUN

(76) Inventor: Paul Piper, P.O. Box 95, Lampasas, TX (US) 76550

( * ) Notice: Subject to any disclaimer, the term of this patent is extended or adjusted under 35 U.S.C. 154(b) by 365 days.

(21) Appl. No.: 11/104,243

(22) Filed: Apr. 11, 2005

(51) Int. Cl.
*F41B 11/26* (2006.01)

(52) U.S. Cl. ..... 124/72; 124/71; 124/73; 124/74; 124/75; 124/76; 124/77

(58) Field of Classification Search ..... 124/71–77
See application file for complete search history.

(56) References Cited

U.S. PATENT DOCUMENTS 2,357,951 A * 9/1944 Hale ..... 124/72
4,083,349 A * 4/1978 Clifford ..... 124/72
2006/0070610 A1* 4/2006 Reeves ..... 124/72

* cited by examiner

*Primary Examiner*—Troy Chambers
(74) *Attorney, Agent, or Firm*—Michael I Kroll

(57) ABSTRACT

A device for firing projectiles comprising a housing having a chamber for retaining projectiles positioned therein and means for expelling the retained projectiles from the housing. An inverted cup is positioned within the chamber and includes an aperture connected to the expelling means. Compressed gas is provided within the chamber by a means for providing compressed gas and a means for activating the providing means is provided as well. Upon activating the activating means compressed gas is provided within the chamber by the providing means causing the projectiles to be caught by the inverted cup and forced through the aperture for expelling therefrom by the expelling means.

17 Claims, 7 Drawing Sheets

COMPRESSED GAS BB AIRGUN

BACKGROUND OF THE INVENTION

1. Field of the Invention

The present invention relates generally to air guns and, more specifically, to, an airgun that fires round ball shot projectiles. The air gun of the present invention is operable using compressed gas provided in a cylinder separate from the airgun. The compressed gas cylinder is coupled to the housing of the airgun by means of pressure hose and fittings. A trigger valve allows the pressurized gas to pass into an air inlet jet and into a pressure canister forcing a plurality of pre-loaded ball shots into a feed cup and out through the barrel. When the trigger is not depressed, the device will not fire. A loading aperture is provided to allow a plurality of ball shot to be loaded into the pressure canister prior to use.

2. Description of the Prior Art

While these airguns may be suitable for the purposes for which they where designed, they would not be as suitable for the purposes of the present invention as heretofore described. The present invention overcomes the shortcomings of the prior art by providing an airgun that fires round ball shot with no moving parts (which means virtually no maintenance), such as "BBs" and operates on compressed gas such as CO2, provided in a cylinder separate from the airgun. The compressed gas cylinder is coupled to the housing of the airgun by means of pressure hose and fittings. A trigger valve allows the pressurized gas to pass into an air inlet jet and into a pressure canister, forcing a plurality of pre-loaded ball shot into the feed cup and out through the barrel. When the trigger is not depressed, the device will not fire. A loading aperture is provided to allow a plurality of ball shot to be loaded into the pressure canister prior to use.

SUMMARY OF THE PRESENT INVENTION

The present invention relates generally to air guns and, more specifically, to, an airgun that fires round ball shot projectiles. The air gun of the present invention is operable using compressed gas, provided in a cylinder separate from the airgun. The compressed gas cylinder is coupled to the housing of the airgun by means of pressure hose and fittings. A trigger valve allows the pressurized gas to pass into an air inlet jet and into a pressure canister forcing a plurality of pre-loaded ball shots into a feed cup and out through the barrel. When the trigger is not depressed, the device will not fire. A loading aperture is provided to allow a plurality of ball shot to be loaded into the pressure canister prior to use.

A primary object of the present invention is to provide an airgun that overcomes the shortcomings of the prior art.

Another secondary object of the present invention is to provide an airgun that fires round ball shots, such as "BBs".

Yet another object of the present invention is to provide an airgun that can shoot a plurality of different type of projectiles including but not limited to rubber or plastic projectiles for use as non-lethal force by law-enforcement or government agencies.

Another object of the present invention is to provide an airgun that uses compressed gas to fire round ball shots therefrom.

Yet another object of the present invention is to provide an airgun that operates on compressed gas such as CO2, HPA, scuba air, shop air or any other pressurized gas.

Still another object of the present invention is to provide an airgun that operates on compressed gas that is not flammable Still yet another object of the present invention is to provide an airgun that operates on compressed gas that produces at least 80 psi Another object of the present invention is to provide an airgun that operates on compressed gas provided in a cylinder separate from the airgun.

Still yet another object of the present invention is to provide an airgun wherein the compressed gas cylinder is coupled to the housing of the airgun by means of pressure hose and fittings.

Another object of the present invention is to provide an airgun including a trigger valve for allowing the pressurized gas to pass into an air inlet jet and into a pressure canister.

Yet another object of the present invention is to provide an airgun including a feed cup for catching the ball shot.

Still another object of the present invention is to provide an airgun wherein a plurality of pre-loaded ball shot are forced into the feed cup and out through the barrel.

Another object of the present invention is to provide an airgun that when the trigger is not depressed, the device will not fire.

Yet another object of the present invention is to provide an airgun having a loading aperture to allow a plurality of ball shot to be loaded into the pressure canister prior to use.

Still another object of the present invention is to provide an airgun that is inexpensive to manufacture and operate.

One more object of the present invention is to provide an airgun that is simple and easy to use.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
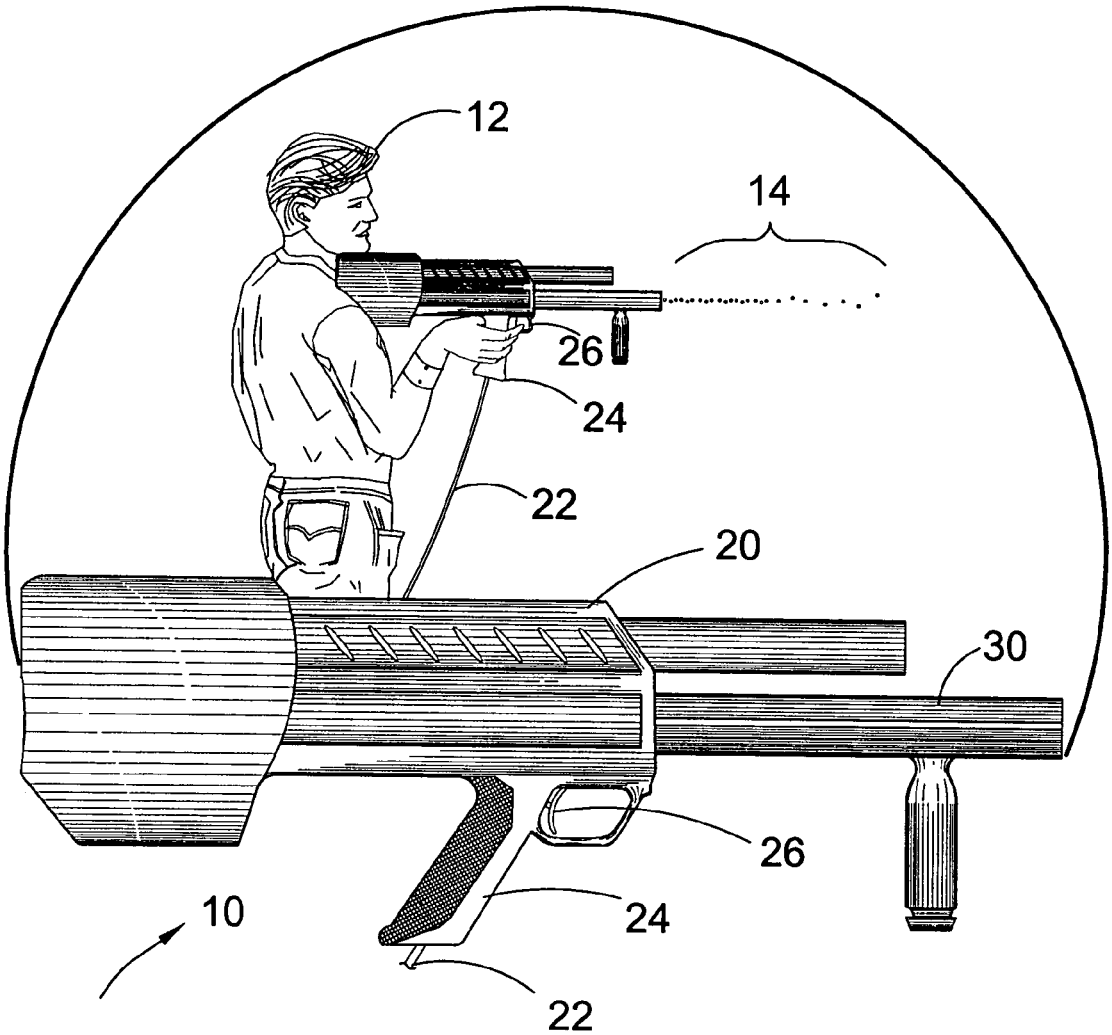
FIG. 1 is an illustrative view of the airgun of the present invention in use.

Turning now descriptively to the drawings, in which similar reference characters denote similar elements throughout the several views, the Figures illustrate the airgun of the present invention. With regard to the reference numerals used, the following numbering is used throughout the various drawing Figures.

10 airgun of the present invention
12 user
14 projectiles
16 loading aperture
18 loading aperture cap
20 housing
22 hose line
24 trigger handle
26 trigger
28 forward handle
30 barrel
32 jet air inlet
34 feed cap
36 pressure canister
38 valve
40 hose fitting
42 regulator
44 gas canister
46 extended projectile magazine

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1-7 illustrate the airgun of the present invention which is indicated generally by the numeral 10.

FIG. 1 is an illustrative view of airgun 10, hereinafter referred to as the "gun" of the present invention in use. The user 12 holds the gun 10 by a trigger handle 24 and depresses a trigger 26 to fire the gun 10. When the trigger 26 is depressed, compressed gas, including but not limited to $CO_2$, HPA, scuba air, shop air or any pressurized gas that is not flammable and produces at least 80 psi, flows from a hose line 22 into a housing 20 and propels projectiles 14 through a barrel 30. When the trigger 26 is not depressed, the device will not fire.

Figure 2:
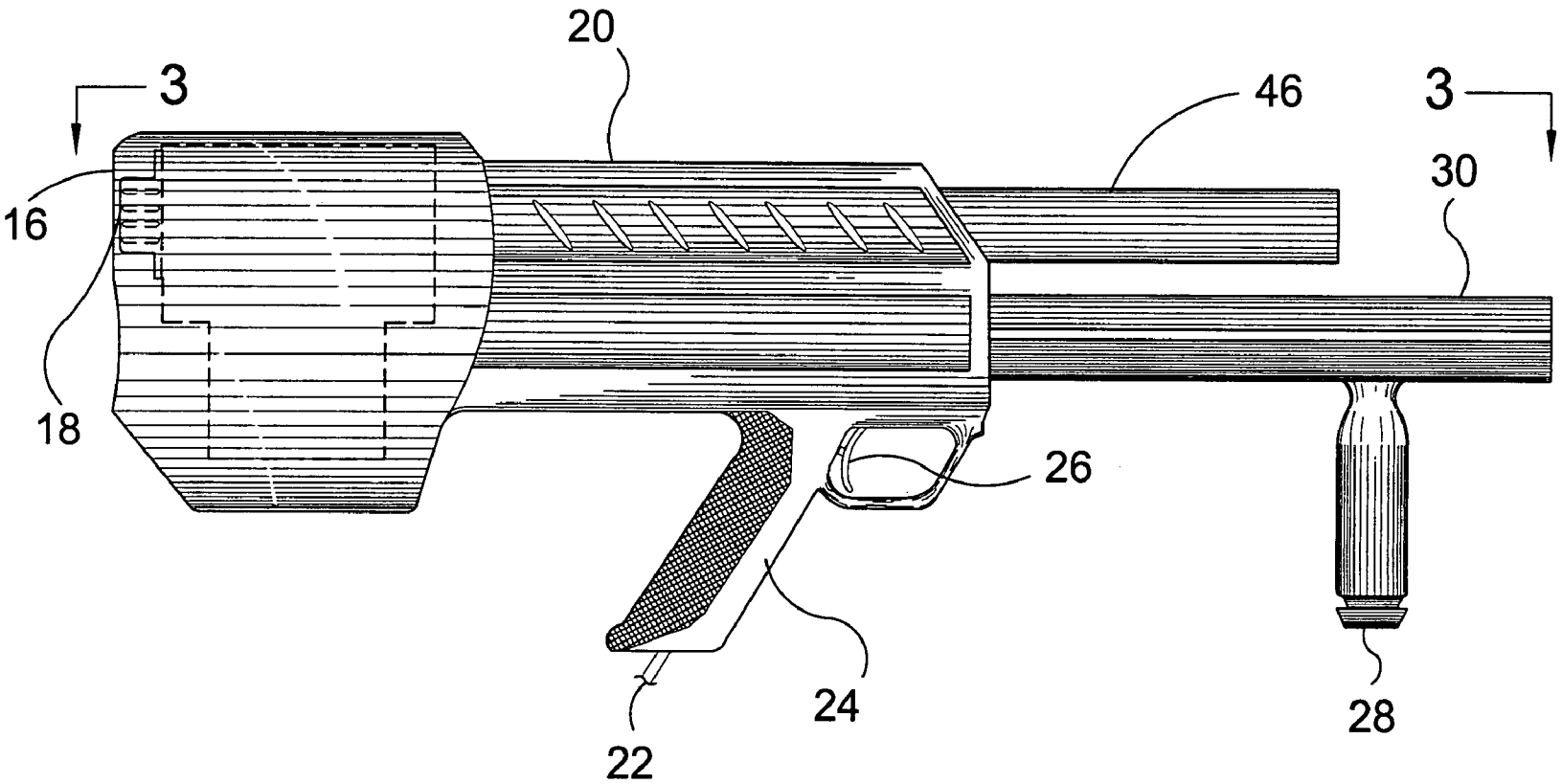
FIG. 2 is a side view of the airgun of the present invention.

FIG. 2 is a side view of the gun 10 of the present invention. The housing 20 of the gun 10 has an aperture 16 for loading a plurality of projectiles 14 prior to use and a selectively removable aperture cap 18 for retaining the projectiles 14 in the gun 10. Positioned within the housing 20 is a pressure canister 36 which is indicated by the dotted lines. The pressure canister 36 retains the projectiles 14 therein. The trigger handle 24 extends outward from the housing 20. The trigger 26 is attached to both the trigger handle 24 and the housing 20. The hose line 22 is attached to the trigger handle 24 to allow the flow of compressed gas into the housing 20. The barrel 30 extends outward from the housing 20 and includes a forward handle 28 attached to an underside thereof barrel 30. The forward handle 28 allows for greater stability when holding the gun 10. An extended projectile magazine 46 for retaining additional projectiles 14 therein extends outwardly from the housing 20 and is parallel to the barrel 30. The extended projectile housing 46 is selectively removeable from the housing and is used to refill the projectiles 14 through the aperture when the pressure canister 36 has been emptied.

Figure 3:
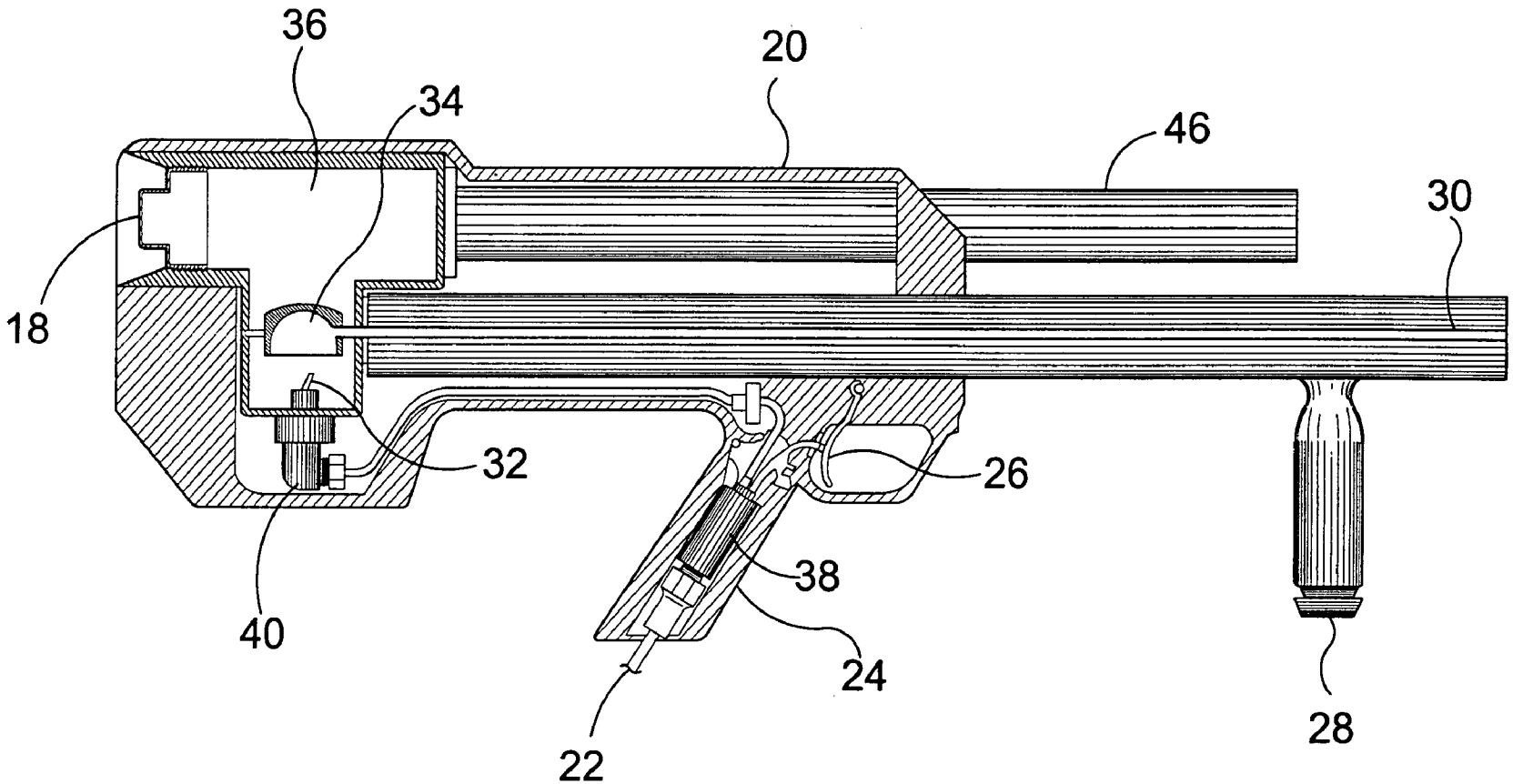
FIG. 3 is a sectional view of the airgun of the present invention.

FIG. 3 is a sectional view of the gun 10 of the present invention. Shown is a sectional view of the present invention taken along the line 3-3 in FIG. 2, revealing the internal components and inner housing of the gun 10. The housing 20 of the gun 10 has the aperture 16 for loading a plurality of projectiles 14 prior to use and the selectively removable aperture cap 18 for retaining the projectiles 14 within the gun 10. When the projectiles 14 are loaded through the aperture 16 they are received retained within the pressure canister 36. Also located in the pressure canister 36 is a feed cup 34 in a prone position having an opening which corresponds to a first end of the barrel 30. The feed cup 34 is able to route the projectiles 14 received therein through the opening and into the barrel 30. In the bottom of the pressure canister 36, located below the feed cup 34 is a jet air inlet 32. The jet air inlet 32 is attached to a hose fitting 40. Extending outward from the hose fitting 40 is a hose line 22 that is attached to a valve 38. Extending outward from the valve 38 and hence the trigger handle 24 is the hose line 22 which is connected to a pressurized gas canister 44, shown in FIG. 4, for selectively providing pressurized gas to the gun 10 of the present invention. The valve 38 determines whether compressed gas is allowed to flow into the pressure canister 36. The valve 38 is located in the trigger handle 24.

The feed cup 34 is shaped like an inverted cup to catch the projectiles 14 that are propelled by the compressed gas from the jet air inlet 32 which is pumped into the pressure canister 36. The barrel 30 extends outward from the housing 20. A forward handle 28 is attached to the underside of the barrel 30 and allows for greater stability when holding the gun 10. An extended projectile magazine 46 also extends outwardly from the housing 20 and is parallel to the barrel 30. The extended projectile housing 46 is selectively removeable from the housing and is used to refill the projectiles 14 through the aperture when the pressure canister 36 has been emptied.

Figure 4:
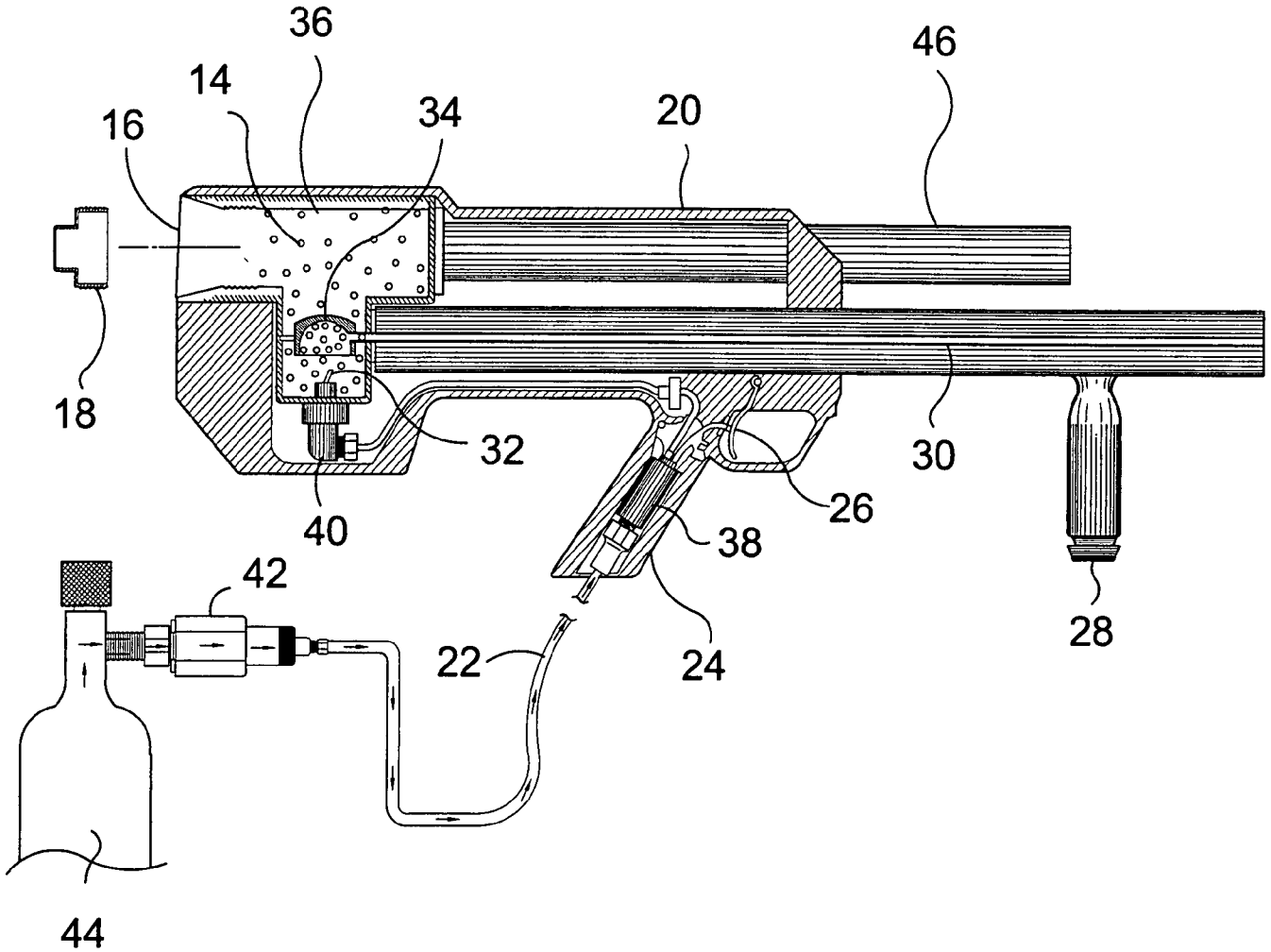
FIG. 4 is a sectional view of the airgun of the present invention.

FIG. 4 is a sectional view of the gun 10 of the present invention. Shown is a sectional view of the present invention revealing the internal working components and inner housing that comprise the present invention. The housing 20 of the gun 10 has the aperture 16 for loading a plurality of projectiles 14 prior to use and the selectively removable aperture cap 18 for keeping the projectiles 14 in the gun 10. When the projectiles 14 are loaded through the aperture 16 they are received and retained within the pressure canister 36. Also located in the pressure canister 36 is a feed cup 34 in a prone position having an opening which corresponds to a first end of the barrel 30. The feed cup 34 is able to route the projectiles 14 received therein through the opening and into the barrel 30. In the bottom of the pressure canister 36, located below the feed cup 34 is a jet air inlet 32. The jet air inlet 32 is attached to a hose fitting 40. Extending outward from the hose fitting 40 is a hose line 22 that is attached to a valve 38. Extending outward from the valve 38 and hence the trigger handle 24 is the hose line 22 which is connected to a pressurized gas canister 44 for selectively providing pressurized gas to the gun 10 of the present invention. The valve 38 which determines whether compressed gas is allowed to flow to the pressure canister 36. The valve 38 is located in the trigger handle 24. The barrel 30 extends outward from the housing 20. A forward handle 28 is attached to the underside of the barrel 30 and allows for greater stability when holding the gun 10. An extended projectile magazine 46 also extends outwardly from the housing 20 and is parallel to the barrel 30.

The feed cup 34 is shaped like an inverted cup to catch the projectiles 14 that are propelled by the air from the jet air inlet 32 which is pumped into the pressure canister 36. The feed cup 34 is shaped like an inverted cup to catch the projectiles 14 that are propelled by the air from the jet air inlet 32 which is pumped into the pressure canister 36. The hose line 22 is connected to a regulator 42, which is attached to a pressurized gas canister 44. The pressurized gas canister 44, provides the compressed gas, including but not limited to $CO_2$, HPA, scuba air, shop air or any pressurized gas that is not flammable and produces at least 80 psi.

Directional arrows representing the path of the compressed gas are shown herein. The arrows and hence the gas originate in the gas canister 44. From the gas canister 44, the gas flows through the regulator 42. The gas flows through the regulator 42 and into the hose line 22. From the hose line 22, the gas flows to the valve 38 located in the trigger handle 24. Herein, the trigger 26 has not been depressed and thus the valve 38 remains closed. The closed valve 38 prevents the gas from flowing further into the gun 10.

Figure 5:
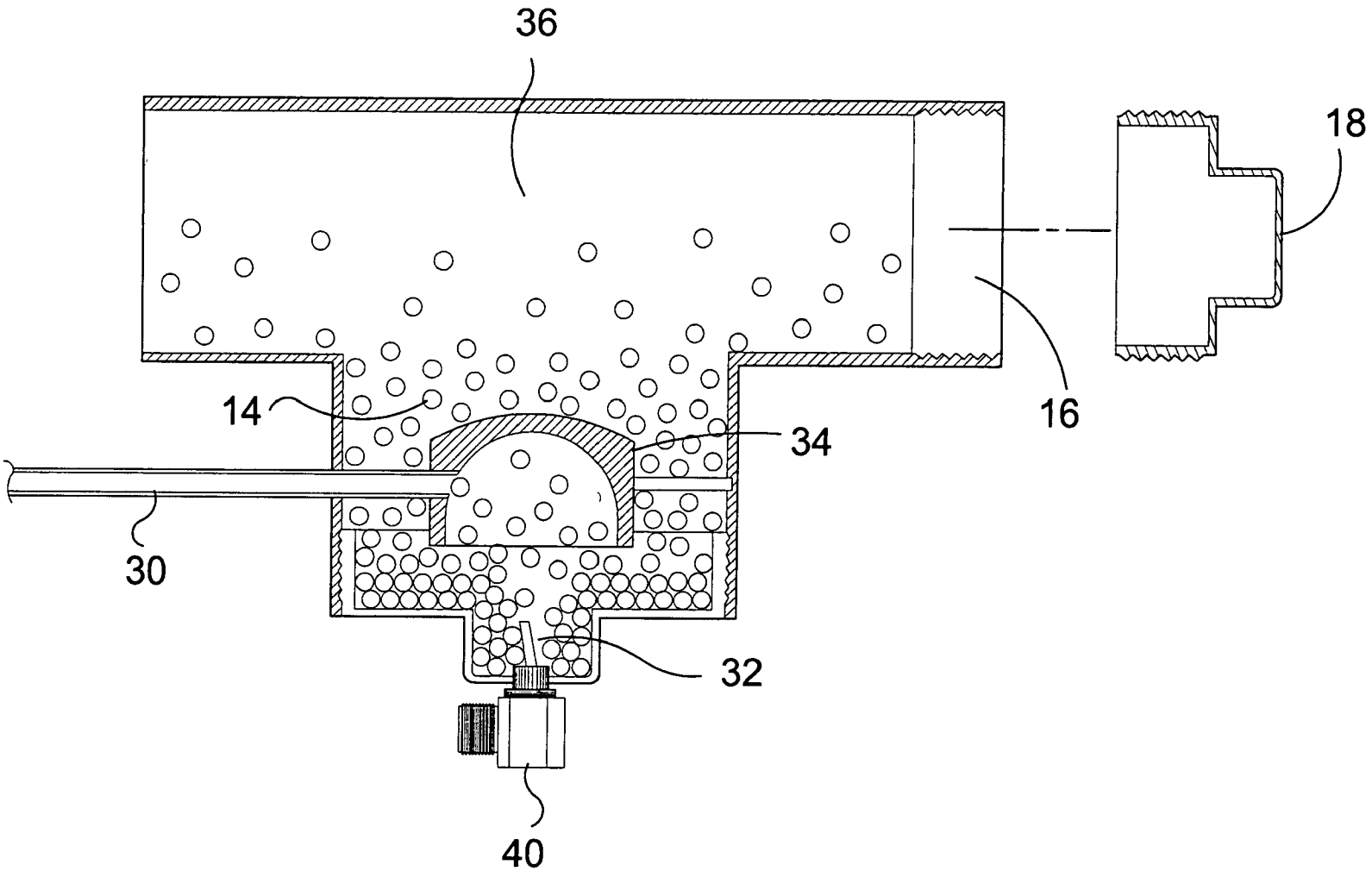
FIG. 5 is a sectional view of the firing chamber of the airgun of the present invention.

FIG. 5 is a sectional view of the firing chamber of the gun 10 of the present invention. Shown is the firing chamber of the gun 10 of the present invention that fires round ball shot, such as "BBs" 14 and operates on compressed gas, including but not limited to $CO_2$, HPA, scuba air, shop air or any pressurized gas that is not flammable and produces at least 80 psi. The housing 20 of the gun 10 has the aperture 16 for loading a plurality of projectiles 14 prior to use and the selectively removable aperture cap 18 for keeping the projectiles 14 in the gun 10. When the projectiles 14 are loaded through the aperture 16 they are received retained within the pressure canister 36. Also located in the pressure canister 36 is a feed cup 34 in a prone position having an opening which corresponds to a first end of the barrel 30. The feed cup 34 is able to route the projectiles 14 received therein through the opening and into the barrel 30. In the bottom of the pressure canister 36, located below the feed cup 34 is a jet air inlet 32. The jet air inlet 32 is attached to a hose fitting 40. Compressed gas is introduced into the pressure canister 36 via the jet air inlet 32 when a user selectively chooses to fire the gun. The projectiles 14 are pooled in the bottom of the pressure canister 36 and as compressed gas flows through the jet air inlet 32, the compressed gas propels the projectiles 14 upward. The propelled projectiles that are caught by the feed cup 34 are then fed through the barrel 30 of the gun 10.

Figure 6:
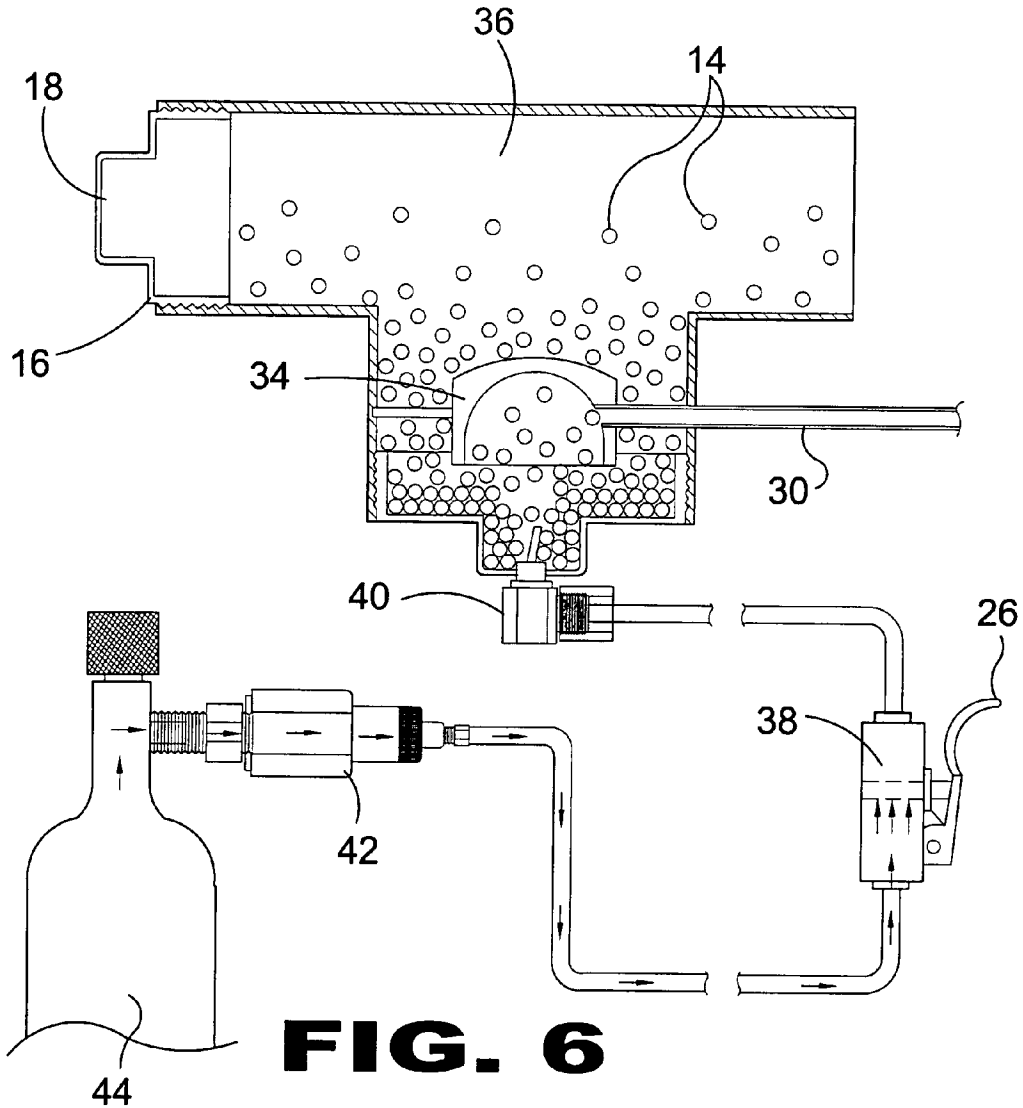
FIG. 6 is a sectional view of the firing chamber of the airgun of the present invention attached to a gas canister and pressure valve in closed position.

FIG. 6 is a sectional view of the firing chamber of the gun 10 of the present invention attached to a gas canister 44 and pressure valve 38 in a closed position. The housing 20 of the gun 10 has the aperture 16 for loading a plurality of projectiles 14 prior to use and the selectively removable aperture cap 18 for keeping the projectiles 14 in the gun 10. When the projectiles 14 are loaded through the aperture 16 they are received retained within the pressure canister 36. Also located in the pressure canister 36 is a feed cup 34 in a prone position having an opening which corresponds to a first end of the barrel 30. The feed cup 34 is able to route the projectiles 14 received therein through the opening and into the barrel 30 which extends through the housing 20 as in FIG. 1. In the bottom of the pressure canister 36, located below the feed cup 34 is a jet air inlet 32. The jet air inlet 32 is attached to a hose fitting 40. Extending outward from the hose fitting 40 is a hose line 22 that is attached to a valve 38, which determines whether compressed gas is allowed to flow to the pressure canister 36. Extending outward from the valve 38 is the hose line 22. The hose line 22 is connected to a regulator 42, which is attached to a pressurized gas canister 44. The feed cup 34 is shaped like an inverted cup to catch the projectiles 14 that are propelled by the air from the jet air inlet 32 which is pumped into the pressure canister 36. The feed cup 34 is shaped like an inverted cup to catch the projectiles 14 that are propelled by the air from the jet air inlet 32 which is pumped into the pressure canister 36. The hose line 22 is connected to a regulator 42, which is attached to a pressurized gas canister 44. The pressurized gas canister 44, provides the compressed gas, including but not limited to $CO_2$, HPA, scuba air, shop air or any pressurized gas that is not flammable and produces at least 80 psi.

Directional arrows representing the path of the compressed gas are shown herein. The gas in the gas canister 44 flows through the regulator 42 and into the hose line 22. From the hose line 22, the gas flows to the valve 38 located in the trigger handle 24. Herein, the trigger 26 has not been depressed and thus the valve 38 remains closed. The closed valve 38 prevents the gas from flowing further into the gun 10. Thus, when the trigger 26 is not depressed, the device will not fire.

Figure 7:
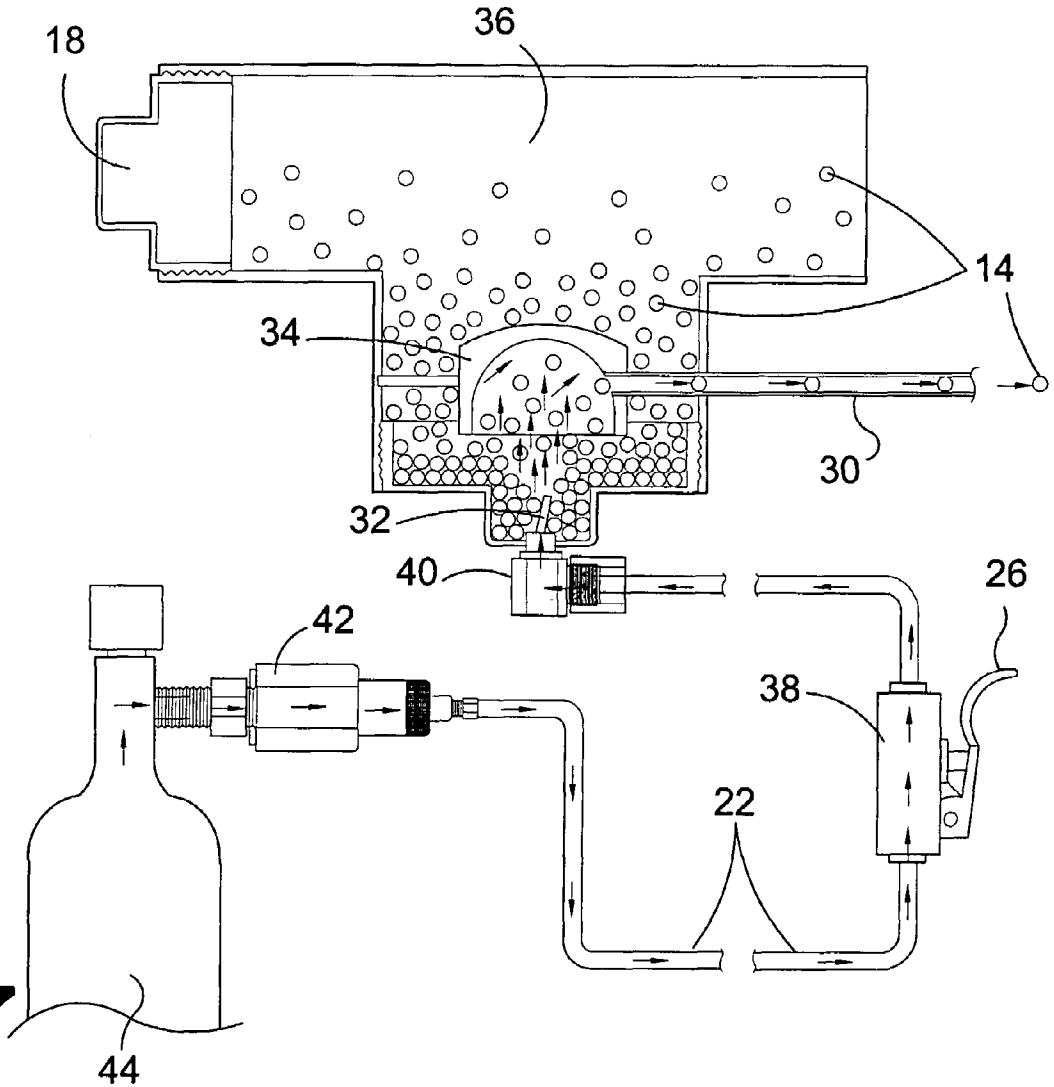
FIG. 7 is a sectional view of the firing chamber of the airgun of the present invention attached to a gas canister and pressure valve in open or fire position.

FIG. 7 is a sectional view of the firing chamber of the gun 10 of the present invention attached to a gas canister 44 and pressure valve 38 in an open or fire position. The housing 20 of the gun 10 has the aperture 16 for loading a plurality of projectiles 14 prior to use and the selectively removable aperture cap 18 for keeping the projectiles 14 in the gun 10. When the projectiles 14 are loaded through the aperture 16 they are received retained within the pressure canister 36. Also located in the pressure canister 36 is a feed cup 34 in a prone position having an opening which corresponds to a first end of the barrel 30 which extends through the housing 20. The feed cup 34 is able to route the projectiles 14 received therein through the opening and into the barrel 30. In the bottom of the pressure canister 36, located below the feed cup 34 is a jet air inlet 32. The jet air inlet 32 is attached to a hose fitting 40. Extending outward from the hose fitting 40 is a hose line 22 that is attached to a valve 38, which determines whether compressed gas is allowed to flow to the pressure canister 36. Extending outward from the valve 38 is the hose line 22. The hose line 22 is connected to a regulator 42, which is attached to a pressurized gas canister 44. The feed cup 34 is shaped like an inverted cup to catch the projectiles 14 that are propelled by the air from the jet air inlet 32 which is pumped into the pressure canister 36. The feed cup 34 is shaped like an inverted cup to catch the projectiles 14 that are propelled by the air from the jet air inlet 32 which is pumped into the pressure canister 36. The hose line 22 is connected to a regulator 42, which is attached to a pressurized gas canister 44. The pressurized gas canister 44, provides the compressed gas, including but not limited to $CO_2$, HPA, scuba air, shop air or any pressurized gas that is not flammable and produces at least 80 psi.

Directional arrows representing the path of the compressed gas are shown herein. The gas originates in the gas canister 44 gas and flows through the regulator 42 and further into the hose line 22. From the hose line 22, the gas flows to the valve 38 located in the trigger handle 24. Herein, the trigger 26 has been depressed and thus the valve 38 is in an open position. The opened valve 38 permits the gas to flow further in the hose line 22 to the hose fitting 40 to be provided to the jet air inlet 32 located in the pressure canister 36. The compressed gas that flows through the jet air inlet 32 forces the projectiles 14, resting adjacent thereto, up and into the feed cup 34. The pressure from the gas forces the projectiles 14 against the contour of the feed cup 34 until the projectiles 14 reach the opening of the barrel 30. From the feed cup 34, the projectiles 14 follow the path of least resistance and are propelled through the barrel 30. Thus when the trigger 26 is depressed, the device will fire. As the projectiles 14 are forced out of the barrel 30, additional projectiles 14 in the canister 36 fall to an area thereof adjacent to the jet air inlet 32. This allows for the gun 10 to continually fire until the pressure canister 36 no longer has any projectiles 14 or until the gas in the canister 44 is no longer available.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A device for firing projectiles comprising:

a) A housing having a chamber for retaining projectiles positioned therein;

b) Means for expelling said retained projectiles from said housing;

c) An inverted cup positioned within said chamber and having an aperture connected to said expelling means;

d) Means for providing a compressed gas within said chamber; and e) Means for activating said providing means; wherein upon activating said activating means compressed gas is provided within said chamber by said providing means causing said projectiles to be caught by said inverted cup and forced through said aperture for expelling therefrom by said expelling means.

2. The device as recited in claim 1, further comprising a loading aperture extending through each of said housing and said chamber for loading said projectiles therein.

3. The device as recited in claim 2, further comprising a lid releasably connected within said aperture for sealing said projectiles therein.

4. The device as recited in claim 1, wherein said housing is shaped as a gun.

5. The device as recited in claim 1, wherein said expelling means is shaped as a cylinder having a channel extending therethrough and along a length thereof.

6. The device as recited in claim 5, wherein a diameter of said channel is substantially equal to a diameter of said projectiles.

7. The device as recited in claim 1, wherein said providing means comprises:

a) A canister having a compressed gas contained therein;

b) A jet air inlet positioned within said chamber;

c) A one-way valve connected to said activating means; and d) a first hose for connected said canister with said value; and e) a second hose for connecting said value with said jet air inlet.

8. The device as recited in claim 7, wherein upon activating said activating means, said valve is moved from a first closed position to a second open position thereby allowing said compressed gas to be provided through said hose and injected into said chamber by said jet air inlet.

9. The device as recited in claim 1, wherein said activating means is a trigger.

10. The device as recited in claim 9, further comprising a valve connected to said trigger, wherein upon toggling said trigger, said valve moves from a first closed position to a second open position thereby allowing said providing means to provide said compressed gas to said chamber.

11. The device as recited in claim 1, wherein said compressed gas is at least one of carbon dioxide ($CO_2$), HPA, scuba air, shop air and any non-flammable pressurized gas.

12. The device as recited in claim 1, wherein said compressed gas is non-flammable gas having a pressure of substantially at least 80 psi.

13. The device as recited in claim 1, further comprising a container releaseably connected to said housing for retaining additional projectiles therein.

14. The device as recited in claim 1, wherein said projectiles are substantially spherical in shape.

15. The device as recited in claim 1, wherein said projectiles are at least one of a BB and paintball.

16. The device as recited in claim 1, wherein said compressed gas causes at least one of said retained projectiles to enter said inverted cup and move along a surface thereof.

17. The device as recited in claim 16, wherein said aperture extends through a portion of said surface of said inverted cup for receiving said at least one projectile therethrough.

* * * * *